United States Patent [19]

Andrews et al.

[11] Patent Number: 4,978,076

[45] Date of Patent: Dec. 18, 1990

[54] METHOD FOR SEPARATING HAZARDOUS SUBSTANCES IN WASTE FOUNDRY SANDS

[75] Inventors: Robert S. L. Andrews; Gerald J. Reier, both of Fort Worth, Tex.

[73] Assignee: GMD Engineered Systems, Inc., Fort Worth, Tex.

[21] Appl. No.: 500,480

[22] Filed: Mar. 28, 1990

[51] Int. Cl.[5] ..... B02C 21/00

[52] U.S. Cl. ..... 241/5; 241/23; 241/24; 241/DIG. 10

[58] Field of Search ..... 241/5, 23, 24, 30, 14, 241/DIG. 10; 164/5

[56] References Cited

U.S. PATENT DOCUMENTS

| | | | |
|---|---|---|---|
| 2,261,947 | 11/1941 | Bernebl et al. . | |
| 2,433,738 | 12/1947 | Christensen . | |
| 2,478,461 | 8/1948 | Connolly . | |
| 2,821,375 | 1/1958 | Andrews . | |
| 3,330,046 | 11/1967 | Albertus . | |
| 3,857,201 | 12/1974 | Jacob | 241/5 X |
| 4,125,945 | 11/1978 | Westelaken . | |
| 4,130,436 | 12/1978 | Hauser et al. . | |
| 4,144,088 | 3/1979 | Adams . | |
| 4,283,015 | 8/1981 | Smith | 241/5 |
| 4,491,277 | 1/1985 | Bauer | 241/5 |
| 4,508,277 | 4/1985 | Andrews . | |
| 4,549,698 | 10/1985 | Andrews . | |

FOREIGN PATENT DOCUMENTS

| | | |
|---|---|---|
| 156380 | 11/1951 | Australia . |
| 1958726 | 11/1969 | Fed. Rep. of Germany . |
| 2252217 | 10/1972 | Fed. Rep. of Germany . |
| 2508630 | 9/1975 | Fed. Rep. of Germany . |
| 2708961 | 9/1978 | Fed. Rep. of Germany . |
| 1172182 | 11/1969 | United Kingdom . |

*Primary Examiner*—Timothy V. Eley
*Attorney, Agent, or Firm*—Charles D. Gunter, Jr.

[57] ABSTRACT

Hazardous substances are separated from used foundry sand by means of a triple fluid bed thermal reactor, second stage sand cooler and third stage pneumatic attrition scrubber. Temperatures in each of the reactor's beds are precisely controlled, depending upon the nature of the sand being treated, so that hazardous substances can be separated and disposed of, rather than fixing the substances onto the sand grains in insoluble form.

14 Claims, 2 Drawing Sheets

METHOD FOR SEPARATING HAZARDOUS SUBSTANCES IN WASTE FOUNDRY SANDS

BACKGROUND OF THE INVENTION

1. Field of the Invention

The present invention relates to a method for separating hazardous substances from used foundry sand mixtures and is particularly adapted for the separation of heavy metals, such as lead, from used foundry sands so that the heavy metals can be placed in sealed containers for disposal while allowing the recovered sand to be reused in foundry manufacturing processes.

2. Description of the Prior Art

Foundry sand is commonly used to make core molds into which ferrous and non-ferrous metals are cast. The core molds consist of sand bonded with special additives including inorganic binders such as clay, and organic binders, such as phenols, melamine, or urea formaldehyde.

Previously, after the casting has set within the mold, the mold was broken away and discarded. Various factors such as the depletion of natural sand deposits and the cost of disposing of used sand in accordance with recent environmental regulations have now made it economical and advantageous to reclaim the used sand for repeated use.

The type binder used has, in the past, generally dictated the type of reclamation process utilized. Thus, for the inorganic, clay-bonded sands, so called "wet" and "dry" scrubbing techniques have been employed. U.S. Pat. No. 2,261,947, to Barnebl et al, issued Nov. 11, 1941, entitled "Foundry Practice", utilizes the wet scrubbing method in which clay-bonded sands are cleaned in a blasting room by means of high pressure stream of water and sand projected from guns. In the "dry" scrubbing technique, the "dry" sand is projected against an abrasive surface to crack off the clay binder. In both cases, the cleaning action is that of mechanical attrition.

For those sands utilizing the organic resin binders, thermal reclamation techniques have commonly been employed. For example, U.S. Pat. No. 2,478,461, to Connolly issued Aug. 9, 1949, entitled "Apparatus And Method For Treating Foundry Sand", discusses the reclaiming of foundry sand by heating or roasting treatment which causes the organic binders to be burned away. Thermal methods have commonly employed multiple-hearth type furnaces with mechanical "rabble arms" which worked over the used sand and moved the sand through the hearth at elevated temperatures.

None of the previously described techniques proved to be entirely satisfactory for use in reclaiming both the clay-bonded and organic resin-bonded sands, as where a mixture of the sands is present. Also, the efficiency of the previous techniques did not exceed about 70%, with the balance of the waste sand being discarded after each reclamation cycle in municipal landfills.

The majority of the chemical compounds used to bind the aggregate sand grains together to form molds and cores are classified by the U.S. Environmental Protection Agency as air pollutants or as heavy metal, soil and water pollutants. In the case of those foundries casting high leaded bronze, their waste sand contains a high level of lead in addition to the hazardous chemical residues of the resin-bonded molds and cores.

U.S. Pat. No. 4,549,698, issued Oct. 29, 1985, to Andrews, entitled "Method Of Reclaiming Foundry Sand", and assigned to the assignee of the present invention, presented a novel method for reclaiming mixtures of both organic resin-bonded sands and clay-bonded sands. The method utilized a triple fluid bed thermal reactor which combined thermal and abrasive action within the beds to remove both resin-bonded and clay-bonded materials in one continuous operation. The method was not specifically directed to removal of lead contaminated foundry sand, however.

A proposed process for treating a lead containing waste sand to produce a landfill material impervious to the leaching effects of ground or rain waters is described in U.S. Pat. No. 4,408,985, issued Oct. 11, 1983, to Anderson et al. The process described is a "roasting" method using a rotary kiln. It is claimed that a chemical reaction occurs between the oxidized lead and silicon dioxide to form lead silicates, thereby "fixing" the lead as an insoluble compound on the sand grains. However, attempts to substantiate the theory of lead fixation by this method have proved unsuccessful.

The Final Rulings Of The U.S. Environmental Protection Agency, Title 40, Section 132,0102, Mar. 11, 1980, as described in 40 CFR Part 260 et al. include a specific method for determining the leachate in a solid waste. The new method, "Toxicity Characteristic Leaching Procedure" is based on acid digestion of metals. The current maximum permissible lead content in the "leachate" is 5 milligrams per liter. Expressed as a ratio, this is 5 parts of lead per million parts of water. Because the test procedure is based on acid digestion of metals, the procedure effectively eliminates any means of diluting toxic waste remaining in the sand or "fixing" the toxic waste as an insoluble compound and still comply with the regulations. In addition, a standard of 0.51 milligram per liter has been promulgated for treated toxic wastes.

The present invention has as its object to provide a method for separating the useful base aggregates in waste foundry sands in order that they might be re-used in a closed recirculating sand system that functions as an integral part of a foundry's manufacturing processes.

The invention also has as its object to render the base aggregates non-hazardous as a direct result of a physical separation of the hazardous components from the base aggregate.

Another object of the invention is to highly concentrate the hazardous compounds in the waste as a direct result of the separation method.

Another object is to provide a method whereby all hydrocarbons in the off-gas stream are thermally destroyed, all acid compounds in the off-gas stream are neutralized and all particulate in the off-gas is filtered out prior to release to the atmosphere within the threshold limit values (TLV) promulgated by the final rulings of the U.S. Environmental Pollution Agency.

A further object of the invention is the recovery of a national resource and its conservation.

Another object is the reduction of waste material disposal cost and a reduction in foundry manufacturing cost.

SUMMARY OF THE INVENTION

The method of the present invention utilizes a triple fluid bed thermal reactor with a heat recuperator and precisely controlled reaction conditions to separate hazardous components from the sand aggregates. The waste sand, which has both organic and inorganic binders adhering to the grains thereof, is first passed to a preheat chamber where the sand is heated for a temperature and for a time sufficient to oxidize organic binders present on the surface of the sand grains. The sand is then passed from the preheat chamber, with the inorganic binders still adhering thereto, to a calcining chamber.

The temperature of the calcining chamber is maintained at a temperature and for a time sufficient to complete the oxidation of any residual organic binders present on the surface of the sand grains and to separate any inorganic binders present without fusing the inorganic binders to the surface of the sand grains. The separation of the inorganic binders results in the release of any heavy metals trapped in the inorganic binders as metallic dust. The metallic dust which is released is then separated from the remaining aggregate and the aggregate is passed from the calcining chamber to a cooling chamber. The remaining aggregate is then discharged from the cooling chamber and subjected to a fourth stage of clay de-dusting, preferably using a re-circulating pneumatic system of impact attrition. The clay de-dusting removes any residual inorganic binders from the surface of the sand grains.

The fourth stage of the method is only successful provided the calcining stage is capable of critically controlling the calcining temperature. Too low a temperature in relationship to the pH of the clays will not free them from the surface of the sand aggregates; too high a calcining temperature with respect to the pH of the clays will fuse the clays to the surface of the sand aggregates so that the de-dusting stage becomes ineffective. Such critical temperature control is only achievable in a triple fluid bed reactor such as is described in the previously mentioned U.S. Pat. No. 4,549,698, assigned to the assignee of the present invention. The present invention is considered to be an improvement to the method shown in U.S. Pat. No. 4,549,698, in order to comply with the Final Rulings Of The U.S. Environmental Protection Agency, Title 40, Section 132.0102, Mar. 11, 1980, as described in 40 CFR Part 260 et al.

Additional objects, features and advantages will be apparent in the written description which follows.

DETAILED DESCRIPTION OF THE INVENTION

Figure 3:
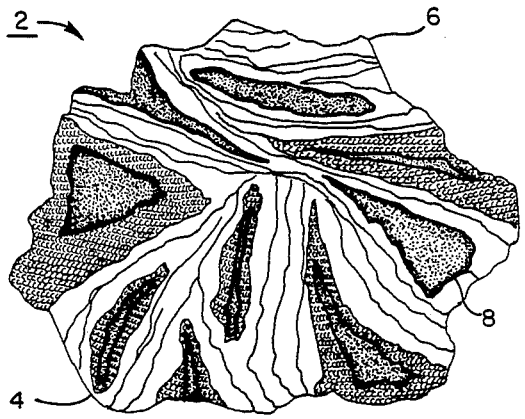
FIG. 3 is a pictorial illustration of a subangular silica sand grain prior to being used in a foundry manufacturing process.

Turning first to FIG. 3, there is shown a microscopic view of a sand grain 2 prior to use in a foundry manufacturing process. The sand grain 2 has rounded areas 4 and sharp cornered areas 6. Random cracks and crevices 8 can also be seen on the surface. As supplied to the foundry, such sands have minor impurities in the form of metallic oxides after being washed and dried prior to delivery as new sand to the foundry.

Figure 4:
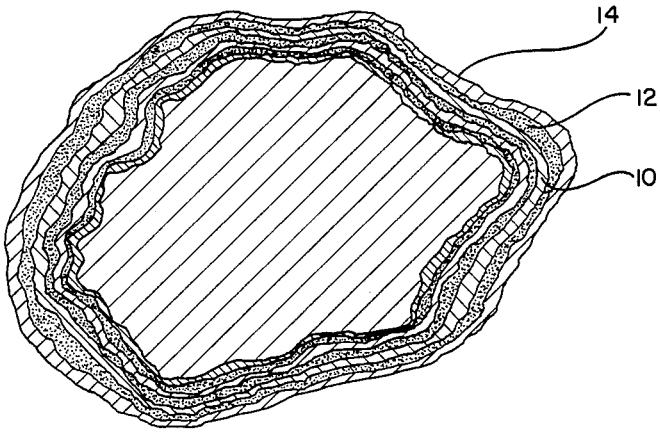
FIG. 4 is a pictorial illustration of a subangular silica sand grain after it has been through the foundry manufacturing cycle of coating with a bentonite clay, molded, cored, and poured with molten metal.

FIG. 4 is a microscopic cross-sectional view of a sand grain after the foundry manufacturing cycle. The used sand grain has been coated with bentonite clay, molded, cored and poured with molten metal. As shown in FIG. 4, the continuous cycling builds up alternate layers of dead clay 10 from the mold, unburned resin bond 12 from the cores and metallic oxides 14 from the molten metal.

Figure 1:
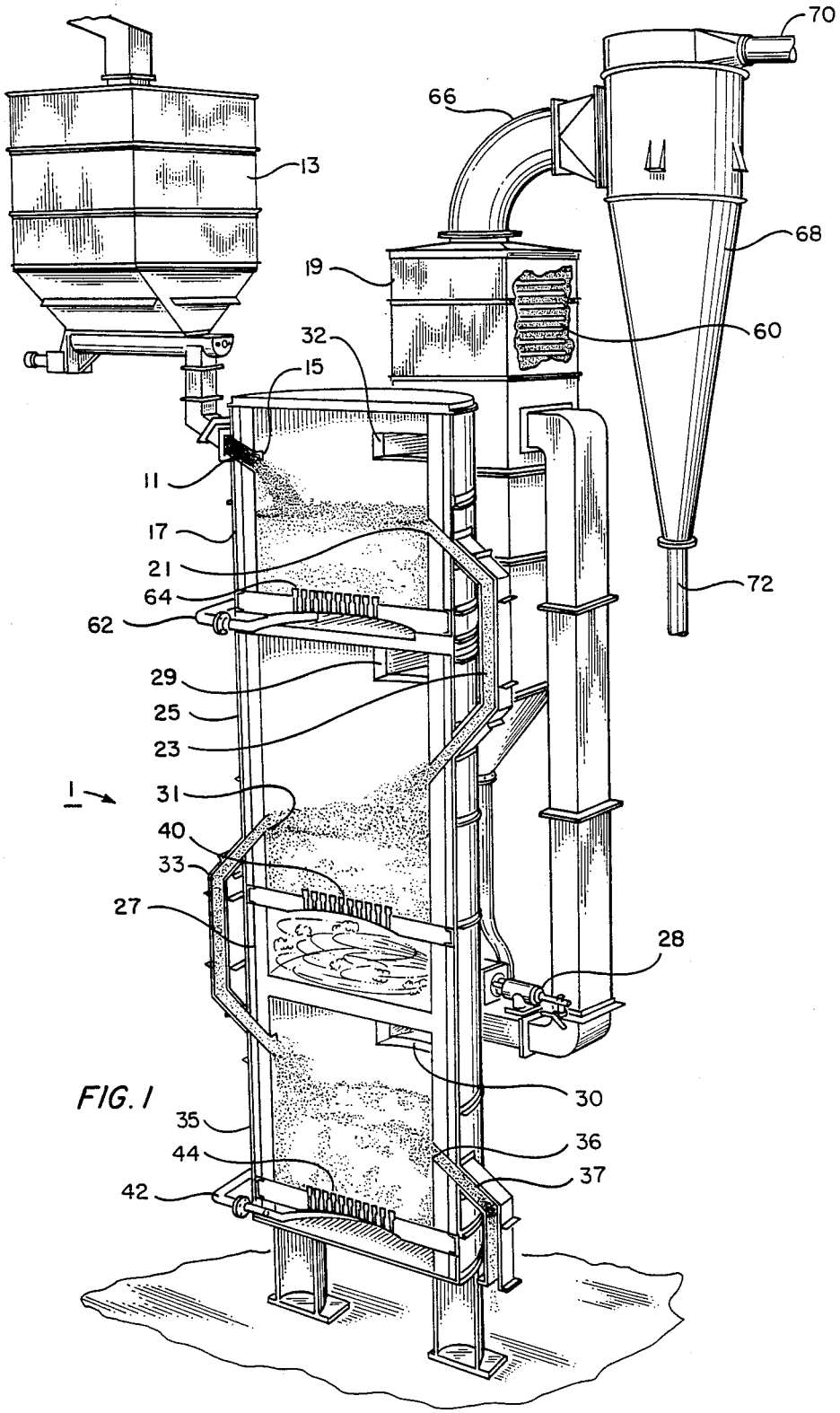
FIG. 1 is a plan view of the triple fluid bed thermal reactor used in practicing the method of the invention with parts broken away for ease of illustration.

The method of the invention is used to separate hazardous waste from the sand grain of FIG. 4, thereby allowing the sand to be re-used in the foundry process. The method will be described with reference to FIG. 1. The dry, waste foundry sand 11 is metered from surge bin 13, through inlet 15, into a preheat chamber 17 of a triple bed thermal reactor (generally designated as 1 in FIG. 1). Preheat chamber 17 comprises a first stage fluid bed which rapidly raises the ambient temperature of the feed material to the fluid bed temperature of 400°-600° F. The first stage fluid bed temperature is maintained by the hot fluidizing air that has been heated by waste heat energy from the reactor's flue gas as it passes through a heat recuperator 19 and which is supplied to the first stage fluid bed through the floor vents 64, as will be subsequently explained.

The oxygen in the hot fluidizing air is used to begin oxidation of the organic binders present on the sand grains in the feed material during an approximate one hour retention time in the first stage fluid bed. The organic compounds present in the feed material are principally fossil fuels, such as powdered coal, coke, pitch or aromatic hydrocarbons such as phenols, coal tar and synthetic resins. These chemical compounds begin to be destroyed at elevated temperature by the heavily oxidizing atmosphere which is created within the hot air fluid bed 17. The off-gases from the bed 17 principally carbon dioxide and hydrogen oxide, pass out the duct 32.

The passage of hot air upward in countercurrent fashion through the fluid bed causes a boiling action in the sand mass. As a result, the base aggregate, with the inorganic compounds still adhering to the surface of the sand grains, passes over a weir 21 and travels down an external by-pass duct 23 into a second stage fluid bed 25 where its temperature is rapidly raised from its 400°-600° F. range to a calcining temperature in the 1450°-1700° F. range. The temperature of the calcining fluid bed is maintained by a hot fluidizing gas consisting of a stoichiometric mixture of a combustible fuel (natural gas, LP gas or oil) and primary combustion air, plus the controlled addition of one hundred percent excess secondary ambient air.

The mixing of the combustion products and excess air takes place at a controlled rate within a pressurized firebox 27 located directly below the calcining bed 25. A nozzle burner 28 is mounted in the sealed firebox 27 to provide combustion. The products of combustion in the firebox 27 are vented through a plurality of vents 40 in the roof of the firebox 27 which is also the floor of the calcining chamber 25. Temperature within the firebox is critically controlled with the nozzle burner 28 to provide the desired calcining temperature of 1450°-1700° F. within the second stage fluid bed 25.

The oxygen provided by the one hundred percent excess secondary fluidizing air completes the oxidation of any residual hydrocarbons trapped within the laminar layers (10, 12 and 14 in FIG. 4) of the inorganic compounds on the aggregate surface. In a typical foundry operation, these inorganic compounds consist mainly of bentonite clays, either Western or Southern, China clay or fire clay, depending upon the type of metal cast upon the sand molds. Each type clay has a characteristic "pH" which determines the optimum calcining temperature for the calcining chamber 25. At a calcining temperature directly related to the proportioning of these clays, namely 1450° F. for Southern bentonites and 1700° F. for the Western bentonites, the fixed moisture retained within these inorganic compounds initiates a crystalline transformation during the one hour retention time within the calcining bed 25. This crystalline transformation causes the laminar clay layers to separate from the sand grains as dust, rather than being "fixed" in insoluble form on the sand grain.

As the calcined clays are converted to dust, heavy metals trapped between the laminar clay layers are released. On being released, the aggregate dust, clay fines and metallic dust are elutriated out of the second stage fluid bed 25. These dusts are transported out of the fluid bed 25 through duct 29 to mix with the other off-gases passing out ducts 30, 32 of the other two chambers before being passed through the reactor's heat recuperator 19.

The calcined aggregate remaining in the second stage bed 25 passes over a weir 31 and through an external by-pass duct 33 by gravity feed to a third stage or pre-cooling bed 35. Ambient fluidizing air is supplied from a conventional rotary blower (not shown) through a supply line 42 and through vents 44 to the pre-cooling bed 35. The temperature of the material entering the bed 35 falls rapidly to 500°-700° F. due to the influx of ambient fluidizing air during the one hour retention time in the bed 35. From the pre-cooling bed 35, the sand is discharged by gravity feed over a weir 36 and through a passage 37 to a post-cooling stage, e.g., fluid bed sand cooler, prior to clay de-dusting. The hot air, heated as a result of cooling the aggregate down from its calcining temperature to the 500°-700° F. range is transported out of the fluid bed 35 through duct 30 to mix with the off-gases from the other two chambers before being passed through the reactor's heat recuperator 19.

The structure and operation of the triple bed thermal reactor 1 are described in greater detail in previously cited U.S. Pat. No. 4,549,698, the disclosure of which is incorporated herein by reference.

The heat recuperator 19 has internal air passageways 60 which are exposed to the heat in the waste gases exiting each of the chamber ducts 29, 30, 32. Ambient air is supplied from a rotary blower (not shown) to the internal passageways 60. The air is heated in the internal passageways 60 and is routed through a conduit 62 to the vents 64 in the floor of the pre-heat chamber 17.

The mean average temperature of the mixed off-gases from the three stages of the process is in the range of 1175°-1250° F. This is above the minimum ignition temperature, at standard temperature and pressure in free air, of any gaseous fuels remaining in the mixture of off-gases prior to passing through the reactor's heat recuperator 19. The recuperator 19 acts as a residence chamber or after burner as the gas mixture passes through at a fixed delay time.

The gases exiting the recuperator 19 pass through duct 66 to a cyclonic particle separator 68 with the fine particles passing out the top duct 70 to a dust collector (baghouse) and the coarse particles to be separated passing out the bottom duct 72.

Figure 2:
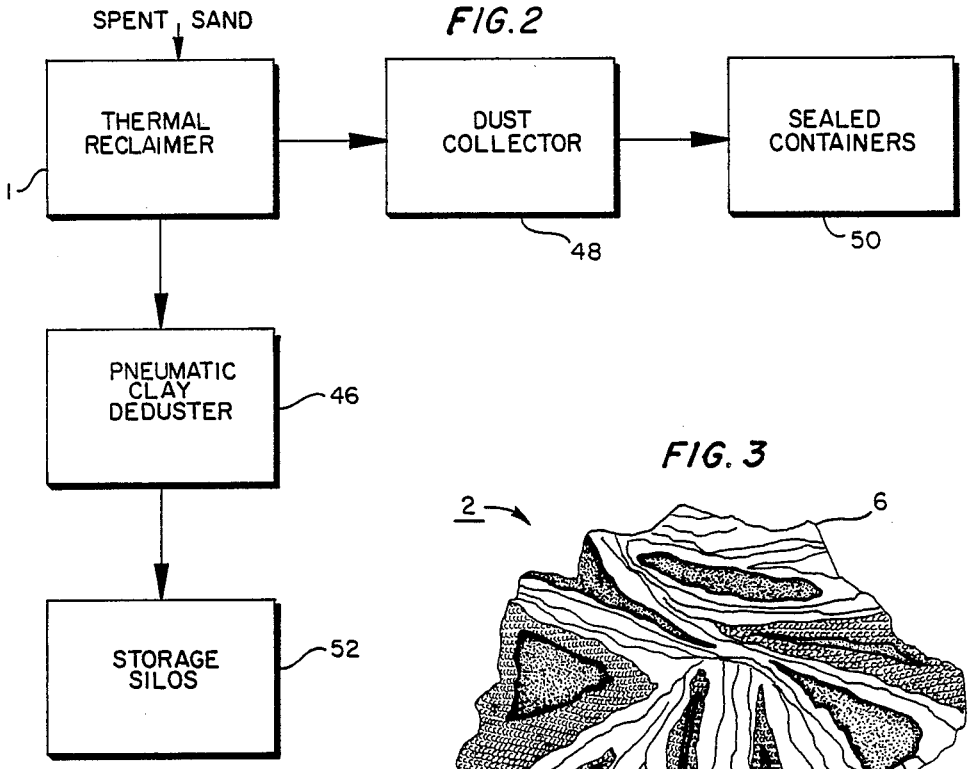
FIG. 2 is a flow diagram showing the operative steps in the method of the present invention.

The aggregate discharged from the post-cooling unit at ambient temperature (85°-90° F.) is fed into a pneumatic attrition clay de-duster (illustrated diagrammatically as 46 in FIG. 2) to remove the residual calcined clay particles from the cracks and crevices of the aggregate. Clay de-dusters of this type will be familiar to those skilled in the art. A suitable de-duster is commercially available from National Engineering Company of Chicago, Ill., as the "NECO Attrition Scrubber." It is this stage that controls the Acid Demand Value (ADV) of the aggregate with respect to its rebonding properties using a core binder system based on an alkaline catalyst. The de-dusted aggregates are conveyed from the de-duster to bulk storage silos (52 in FIG. 2) for re-use in either the clay bonded or resin bonded molding lines or for core making operations.

The aggregate dusts and fines, clay fines and metallic oxide dusts elutriated from the fluid beds, plus the clay dust from the attrition de-duster 46 are preferably transported by the controlled velocity off-gases to a dust collector, such as a standard baghouse 48. The dust and fines are filtered out of the gas stream and collected in the baghouse hopper. The concentrated hazardous dusts are either discharged into sealed containers 50 for transport to an approved treatment facility or into a pelletizing machine. The pelletizing dusts with their content are offered for sale to primary metal smelters for use as cover flux and recovery of elemental metal.

The method of the invention results in several advantages. The present invention separates the toxic materials from used foundry sand rather than "fixing" the toxic materials in an insoluble form. The useful aggregates which remain can be returned to the foundry for re-use in foundry core making. The thermal process utilized complies with the Federal Regulations governing disposal of solid hazardous waste, filter-cake hazardous waste, particulate loading of stack gases and destruction of hydrocarbons in off-gases. The process also complies with regulations concerning neutralization of acid gases in off-gases, such as hydrogen fluoride, hydrogen chloride and sulfur dioxide.

While the invention has been shown in only one of its forms, it is not thus limited but is susceptible to various changes and modifications without departing from the spirit thereof.

We claim:

1. A method for separating hazardous substances including heavy metals in waste foundry sand, the sand also having organic and inorganic binders adhering to the grains thereof, the method comprising the steps of:

passing the waste sand to a preheat chamber wherein the sand is heated to a temperature and for a time sufficient to oxidize organic binders present on the surface of the sand grains in the waste sand;

passing the sand from the preheat chamber with the inorganic binders still adhering thereto to a calcining chamber, the temperature of the sand in the calcining chamber being maintained at a temperature and for a time sufficient to delaminate any inorganic binders present without fusing the inorganic binders to the surface of the sand grains, thereby releasing any heavy metals trapped in the inorganic binders as metallic dust;

separating the released metallic dust from the remaining calcined sand in the calcining chamber;

passing the calcined sand from the calcining chamber to a cooling chamber; and discharging the sand from the cooling chamber to a pneumatic attrition clay de-duster to remove any residual inorganic binders from the surface of the sand grains in the calcined sand.

2. The method of claim 1, wherein the temperature of the preheat chamber is in the range from 400°-600° F. to preheat the waste sand and the temperature in the calcining chamber is in the range from 1450°-1700° F.

3. The method of claim 2, wherein the inorganic binder is a Southern bentonite clay and the calcining temperature is approximately 1450° F.

4. The method of claim 2, wherein the inorganic binder is a Western bentonite clay and the calcining temperature is approximately 1700° F.

5. The method of claim 2, wherein the inorganic binder is a mixture of Southern and Western bentonites and the calcining temperature is a temperature between 1450° F. and 1700° F.

6. The method of claim 2, wherein the cooling chamber is maintained at a temperature to provide a controlled rate of cooling for the calcined sand, the temperature being in the range from about 500°-700° F., and wherein the temperature of the calcined sand in the pneumatic attrition clay de-duster is maintained below about 110° F.

7. A method for separating hazardous substances including heavy metals in waste foundry sand, the sand also having organic and inorganic binders adhering to the grains thereof, the method comprising the steps of:

passing the waste sand to a fluid bed preheat chamber wherein the sand is heated in the range of 400°-600° F. for a time sufficient to begin to oxidize organic binders present on the surface of the sand grains in the waste sand;

passing the sand from the preheat chamber with the inorganic binders still adhering to the surface of the sand grains, through an external gravity-feed passage, to a calcining chamber, the temperature of the sand in the calcining chamber being maintained in the range of 1450°-1700° F. for a time sufficient to convert the inorganic binders present to dust, thereby releasing any heavy metals trapped in the inorganic binders as metallic dust;

separating the released dust, including the metallic dust, from the remaining calcined sand in the calcining chamber;

passing the calcined sand from the calcining chamber to a cooling chamber, the temperature of the sand in the cooling chamber being maintained in the range of 500°-700° F.;

discharging the sand from the cooling chamber to a post cooling unit where the sand temperature is lowered in the range of 95°-110° F. and then discharging the sand to a pneumatic attrition clay de-duster to remove any residual inorganic binders from the surface of the sand grains in the calcined sand.

8. A method for separating hazardous substances including heavy metals in waste foundry sand, the sand also having organic and inorganic binders adhering to the grains thereof, the method comprising the steps of:

passing the waste sand to a fluid bed preheat chamber wherein the sand is heated in the range of 400°-600° F. for a time sufficient to oxidize organic binders present on the surface of the sand grains in the waste sand;

continuously passing the sand from the preheat chamber with the inorganic binders still adhering to the surface of the sand grains, through an external gravity-feed passage, to a calcining chamber which is located below the preheat chamber, the temperatures of the sand in the calcining chamber being maintained in the range of 1450°-1700° F. for a time sufficient to convert the inorganic binders present to dust without fusing the inorganic binders to the sand grains, thereby releasing any heavy metals trapped in the inorganic binders as metallic dust;

separating the released dust, including the metallic dust, from the remaining calcined sand in the calcining chamber and disposing of the separated dust;

continuously passing the calcined sand from the calcining chamber through an external gravity-feed passage to a cooling chamber which is located below the calcining chamber, the temperature of the sand in the cooling chamber being maintained in the range of 500°-700° F.; and discharging the sand from the cooling chamber to a post cooling unit where the sand temperature is lowered in the range of 95°-110° F. and then discharging the sand to a pneumatic attrition clay de-duster to remove any residual inorganic binders from the surface of the sand grains in the calcined sand.

9. The method of claim 8, wherein the fluid bed temperature in the calcining chamber is precisely controlled by means of a hot fluidizing gas consisting of a stoichiometric mixture of combustible fuel and primary combustion air plus the controlled addition of excess secondary ambient air.

10. The method of claim 9, wherein the mixing of the combustion products from the combustible fuel and primary combustion air and the excess air takes place at a controlled rate within a pressurized firebox located below the calcining chamber to thereby maintain a preselected calcining temperature.

11. The method of claim 10, wherein the inorganic binders present on the waste foundry sand are selected from the group consisting of Western bentonite clay, Southern bentonite clay, China clay and fire clay.

12. The method of claim 11, wherein the calcining temperature for sand containing Southern bentonite clays is approximately 1450° F.

13. The method of claim 11, wherein the calcining temperature for sand containing Western bentonite clays is approximately 1700° F.

14. A method for separating hazardous substances including heavy metals in waste foundry sand, the sand also having layers of organic and inorganic binders adhering to the grains thereof, the method comprising the steps of:

passing the waste sand to a fluid bed preheat chamber wherein the sand is heated in the range of 400°-600° F. for a time sufficient to oxidize organic binders present on the surface of the sand grains in the waste sand;

continuously passing the sand from the preheat chamber with the inorganic binders still adhering to the surface of the sand grains, through an external gravity-feed passage, to a calcining chamber which is located below the preheat chamber in vertical fashion, the temperature of the sand in the calcining chamber being maintained in the range of 1450°-1700° F. for a time sufficient to convert the inorganic binders present to dust without fusing the inorganic binders to the sand grains, thereby releasing any heavy metals trapped in the layers of inorganic binders as metallic dust;

separating the released dust, including the metallic dust, from the remaining calcined sand in the calcining chamber and disposing of the separated dust;

continuously passing the calcined sand from the calcining chamber through an external gravity-feed passage to a cooling chamber which is located below the calcining chamber in vertical fashion, the temperature of the sand in the cooling chamber being maintained in the range of 500°–700° F.;

discharging the sand from the cooling chamber to a post cooling unit where the sand temperature is lowered in the range of 95°–110° F. and then discharging the sand to an attrition clay de-duster to remove any residual inorganic binders from the surface of the sand grains in the calcined sand;

connecting a heat exchanger to each of the preheat calcining and cooling chambers by means of a chamber flue located above the sand level in each of the chambers, the heat exchanger being provided with an internal air passageway which is exposed to waste heat exiting each of the chamber flues; and supplying heated air from the heat exchanger internal passageway to the preheat chamber, whereby heat exchanger air is used to heat the preheat chamber as sand is moved successively downwardly between the preheat, calcining and cooling chambers.

* * * * *